US007303358B1

(12) United States Patent
Fuller

(10) Patent No.: US 7,303,358 B1
(45) Date of Patent: Dec. 4, 2007

(54) RECONFIGURABLE BARRIER SYSTEM

(76) Inventor: Charles L. Fuller, 10190 Owen Brown Rd., Columbia, MD (US) 21044

( * ) Notice: Subject to any disclaimer, the term of this patent is extended or adjusted under 35 U.S.C. 154(b) by 146 days.

(21) Appl. No.: 11/076,962

(22) Filed: Mar. 11, 2005

Related U.S. Application Data

(63) Continuation-in-part of application No. 10/659,345, filed on Sep. 11, 2003, now Pat. No. 6,884,002.

(51) Int. Cl.
*E02B 7/08* (2006.01)
*E04H 17/16* (2006.01)

(52) U.S. Cl. ..... 405/114; 52/169.3; 405/116; 405/285; 256/31

(58) Field of Classification Search ..... 405/16, 405/107, 110, 112, 114, 116, 117, 284, 285; 52/169.1, 169.3, 169.4, 780, 781; 256/19
See application file for complete search history.

(56) References Cited

U.S. PATENT DOCUMENTS

| | | | | |
|---|---|---|---|---|
| 830,437 | A | 9/1906 | Humphrey | |
| 2,745,638 | A | 5/1956 | O'Connor | |
| 2,763,048 | A | 9/1956 | Sullivan | |
| 2,930,638 | A | 3/1960 | Morrissey | |
| 3,193,255 | A | 7/1965 | Burdett | |
| 3,494,596 | A | 2/1970 | Bellinson et al. | |
| 3,909,998 | A | 10/1975 | Simpson et al. | |
| 3,938,199 | A | 2/1976 | Laven | |
| 4,026,085 | A | 5/1977 | Simpson | |
| 4,292,776 | A | 10/1981 | MacDonald | |
| 4,452,027 | A | 6/1984 | Desai | |
| 4,525,953 | A | 7/1985 | Stutzman | |
| 4,804,299 | A | 2/1989 | Forte et al. | |
| 4,867,420 | A | 9/1989 | Anderson | |
| 4,885,877 | A | 12/1989 | Hunt et al. | |
| 4,899,991 | A | 2/1990 | Brunkan | |
| 5,152,117 | A | 10/1992 | Wynar | |
| 5,291,708 | A * | 3/1994 | Johnson | 52/282.2 |
| 5,297,890 | A | 3/1994 | Commins | |
| 5,404,685 | A | 4/1995 | Collins | |
| 5,439,201 | A | 8/1995 | Landreville | |
| 5,505,443 | A | 4/1996 | Padilla | |
| 5,509,457 | A | 4/1996 | Jella | |
| 5,671,584 | A | 9/1997 | Mueller | |
| 5,785,447 | A | 7/1998 | Fonti et al. | |
| 5,901,526 | A * | 5/1999 | Vidmar et al. | 52/745.09 |
| 5,944,060 | A | 8/1999 | MacKay | |
| 5,964,058 | A | 10/1999 | Richardson | |

(Continued)

*Primary Examiner*—Tara L. Mayo
(74) *Attorney, Agent, or Firm*—Rosenberg, Klein & Lee

(57) ABSTRACT

A reconfigurable barrier system (10) includes a plurality of support units (100) spaced one from the other, with each support unit (100) having at least one engagement section (110) defining an elongate channel (112). System (10) further includes at least one retention unit (200) that is substantially impervious to liquid, and is supported to extend between a pair of support units (100). Each retention unit (200) is formed with a pair of opposed engagement portions (212) which slidably engage respective ones of the support unit channels (112). Each retention unit (200) is also formed with a seal portion (220) that extends along a longitudinal edge of at least an intermediate portion (214) between the engagement portions (212). A barrier section (15) is defined by each pair of support units (100) and the at least one retention unit (200) supported thereby.

4 Claims, 9 Drawing Sheets

U.S. PATENT DOCUMENTS

| | | | | |
|---|---|---|---|---|
| 5,993,113 | A | 11/1999 | Darling | |
| 6,042,301 | A | 3/2000 | Sovran | |
| 6,193,085 | B1 | 2/2001 | Nook et al. | |
| 6,202,367 | B1 * | 3/2001 | Marino et al. | 52/102 |
| 6,202,368 | B1 | 3/2001 | Wallace, III | |
| 6,264,172 | B1 | 7/2001 | Ball et al. | |
| 6,293,523 | B1 | 9/2001 | Fendler | |
| 6,394,705 | B1 | 5/2002 | Lefebvre | |
| 6,443,655 | B1 | 9/2002 | Bennett | |
| 6,554,544 | B1 * | 4/2003 | Barkasz | 405/274 |

* cited by examiner

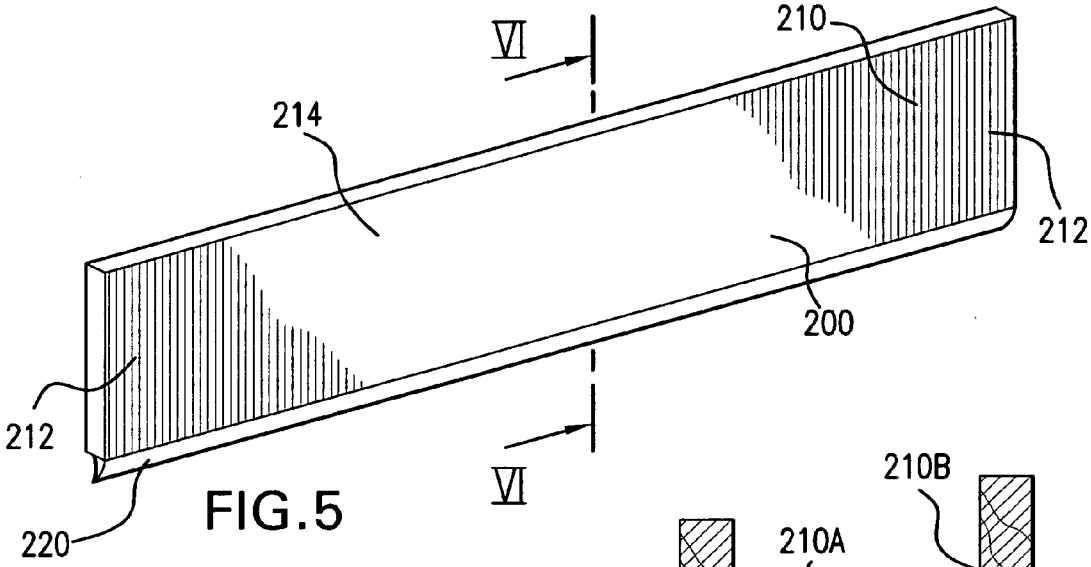
FIG.5
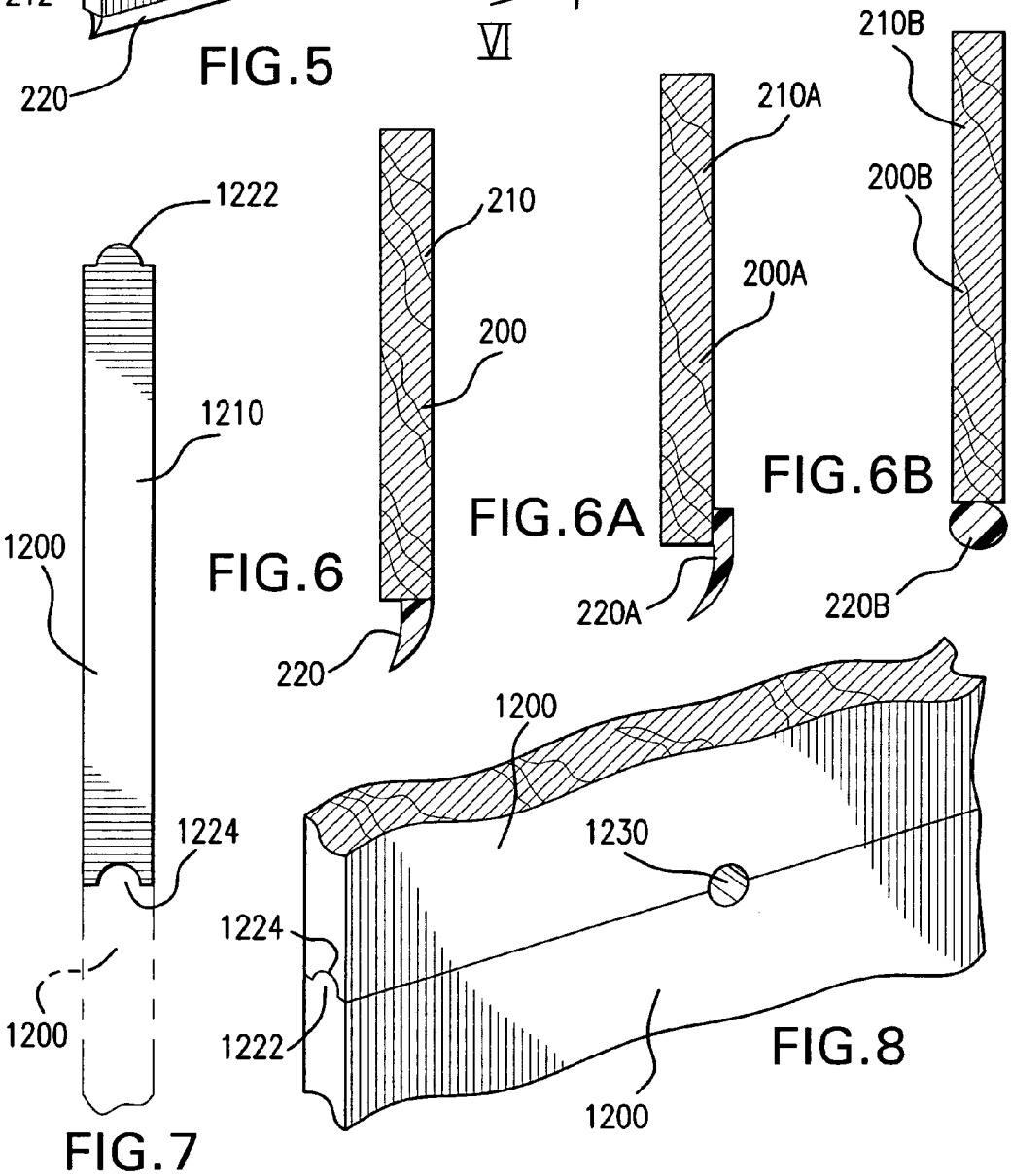
FIG.6
FIG.6A
FIG.6B
FIG.7
FIG.8

RECONFIGURABLE BARRIER SYSTEM

RELATED APPLICATION DATA

This application is a Continuation-In-Part of application Ser. No. 10/659,345, filed 11 Sep. 2003, U.S. Pat. No. 6,884,002.

BACKGROUND OF THE INVENTION

1. Field of the Invention

The subject reconfigurable barrier system is generally directed to a structure that may be temporarily erected to protect particular property, or delineated areas, against the destructive entry of unwanted elements such as rising flood waters. More specifically, the reconfigurable barrier system is a system having structural components which may be modularly assembled to quickly and conveniently erect a barrier structure that is highly secure and stable yet adaptable in configuration to the particular property being protected.

Threats to property are encountered in many forms, from many sources. Some of the most pervasive are found in rising waters due, for instance, to torrential downpours, rapid thawing, and infrastructure failures. Often, such threats arise rapidly and without significant warning, affording little opportunity to erect sufficient barriers in anticipation. This is particularly so in certain geographic regions and low lying areas where combinations of climate, elevation, and geo-terrestrial proximities conspire to realize the threats with much frequency.

In certain cases, permanent measures may be employed to guard persistently against these threats. Such permanent measures, however, tend not only to be aesthetically displeasing, but invariably restrict the properties' productive uses. Consequently, they are not available as viable options in most cases. They certainly are not viable options in most residential applications, for example. There is therefore widespread need for a barrier system which may be temporarily though effectively erected responsive to the occurrence of certain calamitous situations.

Presently, in the event of rapidly rising waters due to torrential downpours or other calamities, a temporary dike is typically erected about the given property to keep it from being even partially immersed in the rising waters until the waters recede. Perhaps the most common approach heretofore known is to simply erect a temporary barrier by stacking individual sand bags. While reasonably effective as a water barrier, this approach is plagued by numerous practical drawbacks.

Among the most notable and obvious of these drawbacks are the cumbersome bulk of the individual sand bags themselves and the great number of such sand bags typically required to build up barrier sections of even modest size. Factor in the fact that these many, heavy sand bags must be first transported to the property in question, unloaded, then stacked individually by hand; and, the approach proves to be extremely labor intensive, prohibitively so in many cases. It does not help that removing the sand bags once the water recedes may be even more labor-intensive given that many sand bags may be water-saturated and, therefore, heavier.

While heavy-lifting power equipment may be employed, doing so may prove prohibitive in cost for many applications. What is more, the prevailing conditions requiring the dike structure in the first place may simply not afford the safe use of such power equipment.

Availability of the sand bag approach is thus usually limited to cases where a small army of laborers are found to pool their efforts together and build the structure heavy bag by heavy bag. Where the requisite manpower is lacking, property otherwise protectable goes unprotected, and substantial property damage occurs unnecessarily.

2. Prior Art

Barrier systems are known in the art, as are various structural components usable in such systems. The best art known to Applicant includes U.S. Pat. Nos. 6,293,523; 6,042,301; 6,443,655; 6,193,085; 6,202,368; 5,505,443; 5,944,060; 5,964,058; 5,509,457; 5,152,197; 5,439,201; 5,297,890; 5,785,447; 5,671,584; 4,525,953; 4,026,085; 4,292,776; 4,867,420; 4,899,991; 4,452,027; 3,494,596; 3,909,998; 2,763,048; 2,930,638; and, 830,437. There is no barrier system heretofore known which combines the degree of simplicity, security of coupling, and convenient reconfigurability realized by the subject reconfigurable barrier system.

SUMMARY OF THE INVENTION

It is a primary object of the present invention to provide a reconfigurable barrier system which may be quickly and conveniently assembled for use then disassembled for transport and storage.

It is another object of the present invention to provide a reconfigurable barrier system that is simple yet highly secure in its structure and intercoupling of components.

It is yet another object of the present invention to provide a reconfigurable barrier system that may be selectively configured about a particular property to keep therefrom potentially invasive elements such as rapidly rising waters.

It is still another object of the present invention to provide a reconfigurable barrier system having simple and reusable components that may be modularly assembled without undue physical exertion.

These and other objects are attained by the subject reconfigurable barrier system which generally includes a plurality of support units spaced one from the other and at least one retention unit supported to extend between a pair of the support units to define a barrier section. Each support unit is formed with at least one engagement section defining an elongate channel. The retention unit is substantially impervious to liquid, and includes a pair of opposed engagement portions, each of which slidably engages one channel of the support unit. An intermediate portion extends between the opposed pair of engagement portions, and a seal portion extends along a longitudinal edge of that intermediate portion.

In certain embodiments, the reconfigurable barrier system also includes a brace unit which engages and reinforces the support of at least one retention unit. The brace unit is formed with a stabilizing member and a tie member extending therefrom to engage the retention unit. Also in certain embodiments, the reconfigurable barrier system includes a plurality of barrier sections joined one to the other to form an endlessly looped barrier configuration about the particular area to be protected.

BRIEF DESCRIPTION OF THE DRAWINGS

FIG. 5 is a perspective view in isolation of yet another portion of the preferred embodiment of the present invention shown in FIG. 2;

FIG. 6 is a sectional view of the portion of the preferred embodiment of FIG. 5;

FIG. 6A is a sectional view in an alternate embodiment of the portion shown in FIG. 6;

FIG. 6B is a sectional view in yet another alternate embodiment of the portion shown in FIG. 6;

FIG. 7 is a side elevational view of an alternate embodiment of the portion of the present invention shown in FIGS. 5 and 6;

FIG. 8 is a perspective view, partially cutaway, of the alternate embodiment of the portion of the present invention of FIG. 7, showing a plurality of the portions joined together;

DETAILED DESCRIPTION OF THE PREFERRED EMBODIMENTS

Figure 1:
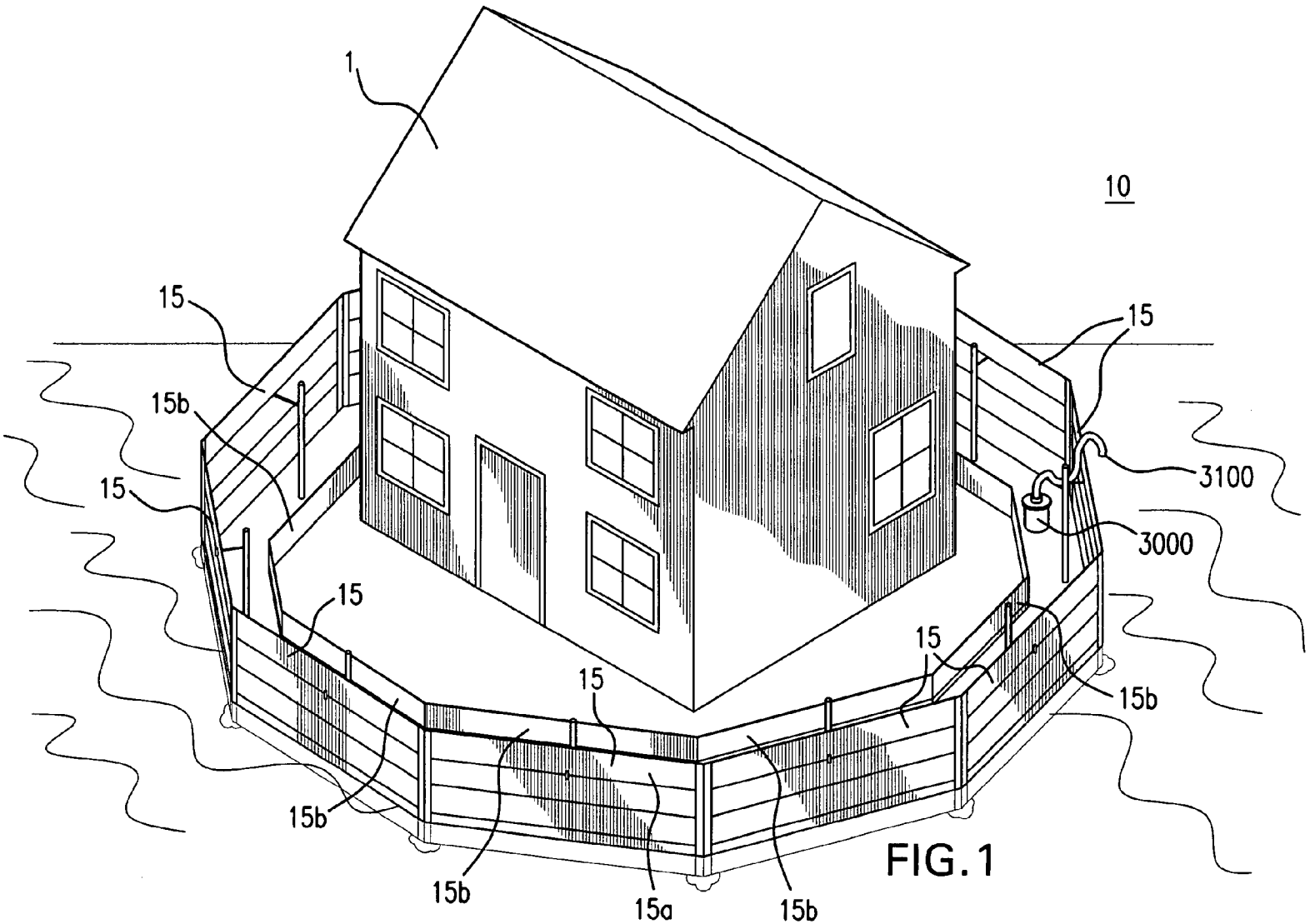
FIG. 1 is a schematic diagram showing a preferred embodiment of the present invention in an exemplary application.
Figure 2:
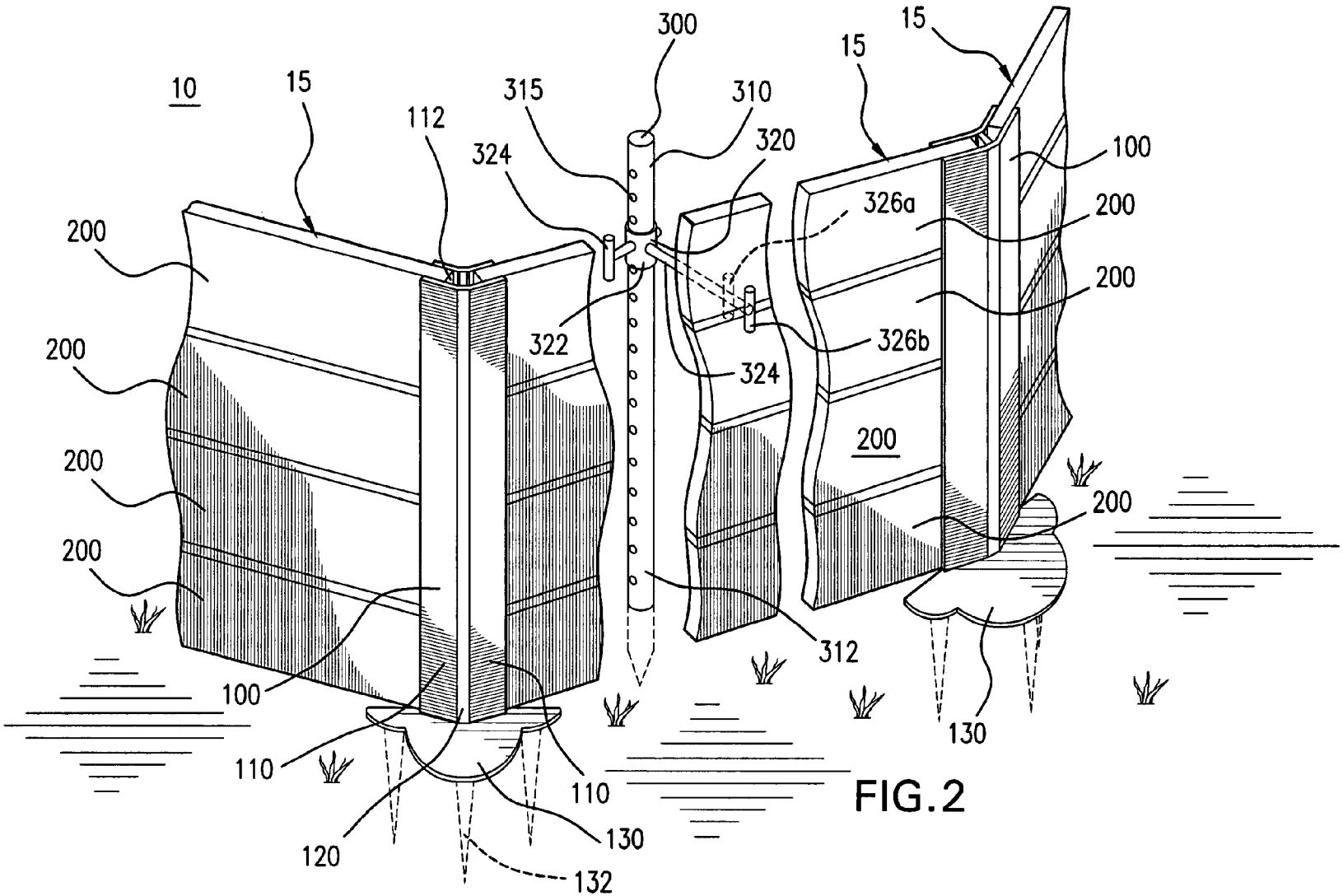
FIG. 2 is a perspective view, partially cutaway, of a preferred embodiment of the present invention, fully assembled.

Referring now to FIGS. 1-2, there is shown one preferred embodiment of the subject reconfigurable barrier system 10 assembled for use in an exemplary application—as a temporary dike for a dwelling 1 and its immediate surroundings. In general concept, the temporary dike application shown for reconfigurable barrier system 10 may be quickly and conveniently erected when the need arises to include one or more barrier sections 15. Preferably, a plurality of barrier sections 15 are joined to define an endless barrier loop about the dwelling 1 and its grounds.

In accordance with the present invention, the number, size, and relative arrangements of barrier sections 15 may be readily varied to suit the particular needs of the given application. The closed loop configuration of barrier sections 15 illustrated in FIG. 1 affords a measure of self-support which enhances the system's overall ability to withstand the considerable pressure that may be applied against the barrier sections' outer sides by rising waters. Where the rising waters are expected to reach lesser levels, for example, the heights of certain barrier sections 15 may be (either uniformly or non-uniformly) lowered accordingly. The certain barrier sections 15 may likewise be formed with increased or reduced lengthwise spans, and the total number of sections 15 correspondingly reduced. Where the requirements of the intended application permit, barrier sections 15 may also be arranged in an open configuration about, perhaps, only a certain portion of the property being protected.

The need for temporary dikes often arises with little warning—with sudden downpours in low-lying areas; the cresting of rivers over their banks due to a thaw following a season of unusually heavy precipitation; or, the failure of water containment and drainage systems, for example. It is an important aspect of the present invention that the components of reconfigurable barrier system 10 may be easily transported to the property in question for quick assembly and installation to erect a protective barrier that conforms to the shape and surface contour of that property; and that this may be accomplished without a great degree of manpower, and without necessitating the use of any special tools.

Barrier sections 15 serve to block the destructive entry of rising waters into the protected property, firmly and securely withstanding the weight of those waters. After the calamity has passed, and the waters have receded to safe levels, reconfigurable barrier system 10 may be quickly disassembled and transported away for storage, again without any great degree of manpower and without the use of special tools.

As illustrated in FIG. 2, each barrier section 15 is defined by a pair of support units 100 spaced a suitable distance one from the other, and one or more retention units 200 supported by paired support units 100 to extend therebetween. System 10 further includes in the embodiment shown a brace unit 300 which engages an intermediate portion of one or more retention units 200 to reinforce the given barrier section's support. Support units 100 and brace units 300 are each preferably provided with structural measures for engaging in anchored manner the ground (or other surface) which underlies system 10 to stabilize and affix the given barrier section 15.

Each support unit 100 is formed with at least one engagement section 110 that defines an elongate, vertically extending channel. Preferably, each support unit 100 includes a pair of such engagement sections 110 projecting laterally outward from an intermediate section 120 disposed therebetween. Engagement sections 110 of a common support unit 100 are configured to be offset from one another in angular orientation, such that an angled sectional contour results for that support unit 100. The paired engagement sections 110 may be offset by any angle suitable for the intended application.

A user preparing to erect a plurality of barrier sections 15 may have at his/her disposal a plurality of support units 100 of various angled profiles formed by their respective engagement sections 110. The user may then arrange suitable combinations of the variously angled support units 100 to effectively 'stake' out the barrier sections about the dwelling 1 or other property to be protected. Individual retention units 200 of sufficient length to span the space between two support units 100 may then be slidably coupled to the engagement sections 110 of those support units 100 to build up barrier sections 15 and develop a protective barrier system 10 encircling the property. Where, of course, the intended application does not require the given property to be fully encircled, the erected barrier system 10 may terminate at one or more support units 100. A dedicated support unit 100 formed perhaps with a single engagement section 110 and/or other structural variations (from that shown in FIG. 2) incorporated to aid its function as a stable end support may be employed in an alternate embodiment.

Preferably, each support unit 100 is formed with a base section 130 projecting transversely from the engagement and intermediate sections 110, 120. This base section 130 is preferably formed with one or more anchoring members 132 that securely engage the surface therebeneath. In the embodiment shown, a portion of each base section 130 serves as a common mounting base for engagement and intermediate sections 110, 120 to augment the overall structural integrity of support unit 100. The remaining portions of base section 130 project transversely from engagement and intermediate sections 110, 120 to form a flanged load bearing platform. This platform provides a convenient point on which to step or otherwise apply a downward force on support unit 100 in driving the anchoring members 132 into the supporting surface underneath.

Where the supporting surface is not extremely hard (as with soil-based ground surfaces), it may be sufficient for the user simply to step on the flanged loading platform of base section 130 and allow his/her weight to drive anchoring members 132. In other cases, it may be necessary to apply a hammering or other impact force to adequately drive anchoring members 132 into the supporting surface. As such a forceful impact directly upon the top edges of engagement and intermediate sections 110, 120 may cause destructive deformation, the flanged loading platform of base section 130 provides a safe and convenient point of impact for such a driving force.

The transversely projecting base section 130 also serves the concurrent purpose of providing a spread contact surface for greater stability of support upon the supporting surface. Preferably, anchoring members 132 are driven far enough into the supporting surface that the bottom face of base section 130 makes substantially flush contact with that supporting surface. This guards against the tipping of the upright support unit 100.

It is to be understood that base section 130 may be configured in any suitable manner permitted by the intended application, and the configuration shown in the FIGS. therefor is only exemplary. Base section 130 may be readily varied in its contour, relative dimensions, and precise positioning and orientation with respect to engagement and intermediate sections 110, 120. Hence, while anchor members 132 are formed in the embodiment shown as individual spikes, they may be formed with any other suitable configuration.

Anchor members 132 may be configured in certain alternate embodiments, for example, to collectively form an arrow-like structure having a crossed sectional contour. In certain other embodiments, base section 130 may be formed without integrally formed anchor members 132, having instead one or more openings formed therein to receive a spike or other extraneous securing member therethrough. In various other embodiments where the supporting surface is impenetrably hard or must be preserved without significant disturbance, anchor members 132 may be configured in any other suitable manner for securement to the supporting surface without driving into it.

It is important that each support unit 100 be of sufficient strength, rigidity, and durability to withstand repeated use in applications where considerable forces may be applied by rising waters, debris, high winds, and the like. Preferably, each support unit 100 is formed of a steel or other metallic material, fabricated and appropriately conditioned to resist corrosion using any suitable means known in the art. Where available, any other material of comparable strength, rigidity, and durability may be employed to form support units 100. The choice of particular material composition for support unit 100, as for any other component of the subject reconfigurable barrier system 10, is not essential to the present invention.

Figures 3A, 3B, 4:
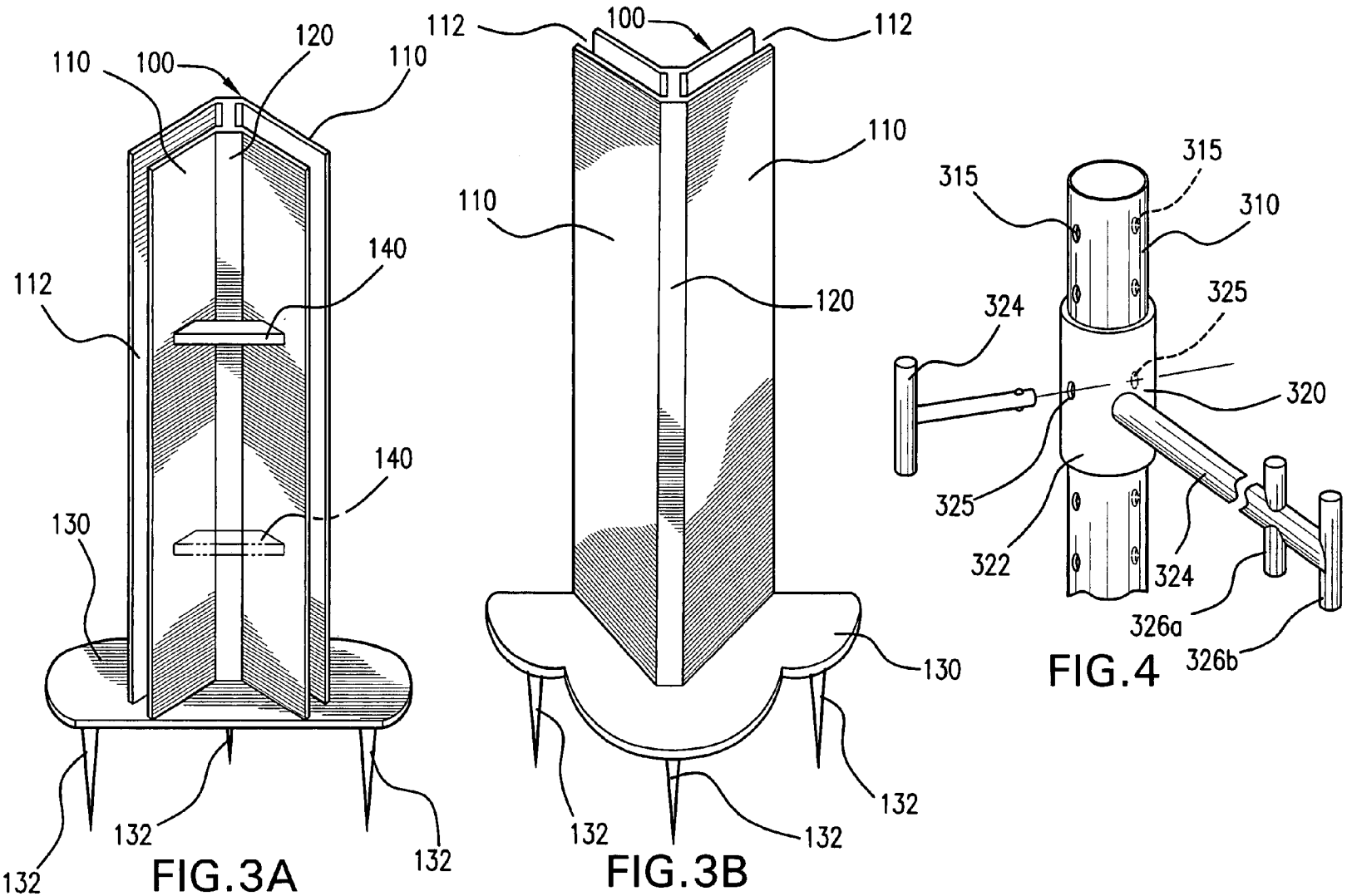
FIG. 3A is an inner perspective view of a portion of the preferred embodiment of the present invention shown in FIG. 2.
FIG. 3B is an outer perspective view of the portion of the preferred embodiment of FIG. 3A.
FIG. 4 is a perspective view, partially cutaway, of another portion of the preferred embodiment of the present invention shown in FIG. 2.

Referring now to FIGS. 3A-3B, the strength and rigidity of each support unit 100 may be further augmented by incorporating one or more angle braces 140 secured between opposing engagement sections 110. Each brace member 140 guards against the buckling of engagement sections 110 when pressure is applied to the outer side of given barrier sections 15 by water, debris, or wind. Additionally, intermediate section 120 is preferably formed with an I-beam or other such construction to maximize its rigidity and strength.

As mentioned, each engagement section 110 defines an elongate channel 112 configured to snugly yet slidably receive an engagement portion of one or more retention units 200. Engagement section 110 may be dimensioned lengthwise (vertically) to accommodate as many edge-to-edge stacked retention units 200 as required by the intended application. Also, the retention units 200 which span the distance between two support units 100 may be of any suitable longitudinal length, and may be considerable in cases. Engagement section 110 of each support unit 100 is accordingly dimensioned in depth (horizontally) to maintain sufficiently secure engagement of the given retention unit(s) 200 despite their length. Some bowing of the retention units' intermediate portions will invariably occur, particularly for longer spans, when subjected to cross forces during use; and, the engagement of sections 110 and retention units 200 must be provided to withstand as much. In actual implementation, such factors as the rigidity of the engagement section panels, the rigidity of the retention unit engagement portions, the distance to be spanned by the engaged retention unit(s), and the magnitude and direction of the forces to be encountered during use will determine the actual dimensional configurations required.

With repeated use and handling, physical distortion of the elongate channels 112 of support unit engagement sections 110 is quite possible. A forceful blow or the overbearing weight of another component upon that engagement section 110 may cause sufficient deformation to disruptively compress the channel in width at one or more points, for instance. Appropriate measures like the use of a gap-plugging insert member in each engagement section's elongate channel 112 may be in order while a support unit 100 is held in storage (when its elongate channels remain disengaged from and therefore unoccupied by any retention units). Such other exemplary measures—like a rigid, handle-like outer bracing member fixedly coupled to extend externally between outer wall portions of each support unit's engagement sections 110—may be employed to secure those outer wall portions from deflection inward into the elongate channel.

The arrangement of barrier sections 15 may be readily varied from the polygonal configuration illustrated in FIG. 1 by selectively setting one or both of two parameters: the angular profile of a support unit 100 shared by adjacent barrier sections 15 and the respective retention unit span lengths for barrier sections 15. Numerous different barrier section arrangements may be formulated by selecting different combinations of components to vary these parameters in the actual assembly and installation of the subject reconfigurable barrier system 10.

To provide lateral support for the intermediate portions of retention units 200 spanning the distance between corresponding support units 100, one or more brace units 300 may be employed in each barrier section 15. Each brace unit 300 includes an elongate stabilizing member 310 from which one or more tie members 320 transversely extend to engage the intermediate portion of at least one retention unit 200. Preferably, stabilizing member 310 is formed with a pole portion 312 having a plurality of coupling holes 315 formed therealong. Tie member 320 is formed with a collar portion 322 which telescopically engages pole portion 312 of stabilizing member 310 for adjustable axial displacement along its length. Collar portion 322 is formed with diametrically opposed coupling holes 325 to receive a pin 321 or other fastening member when aligned with corresponding coupling holes 315 of stabilizing member pole portion 312. Tie member 320 is thereby locked in releasable manner at a selected position along stabilizing member 310.

Tie member 320 further includes an arm portion 324 extending radially from collar portion 322 toward the retention unit(s) 200 to be reinforced. This arm portion 324 is terminated preferably by a hook portion 326 which retentively engages an intermediate portion of the given retention unit(s) 200. Hook portion 326 in the embodiment shown includes a pair of hooking elements 326*a*, 326*b* spaced from one another to engage a longitudinal edge of the retention unit 200. Preferably, each hooking element 326*a*, 326*b* extends both transversely upward and downward relative to arm portion 324 such that they may concurrently engage portions of both the upper and lower ones of a stacked pair of retention units 200, with the section of arm portion 324 connecting hooking elements 326*a*, 326*b* captured between the stacked retention units 200.

It may be advantageous in certain embodiments to position pole portion 312 to bear against and extend vertically across a barrier section's retention unit(s) 200. In that case, the need for a second hooking element 326*a/b* is obviated, as the pole portion 312 may itself be sufficient to provide the required support against inward lateral deflection of the retention unit(s) 200. Only one of the hooking elements 326*a/b* shown would then be necessary to provide support against outward lateral deflection of such retention unit(s) 200. One or more suitably configured tie members 320 may be employed on pole portion 312 in accordance with such alternate embodiments.

While it serves to brace intermediate portions of retention units 200 against lateral deflection when subjected during use, for instance, to the weight of rising waters bearing against the outer surfaces of those retention units 200—brace unit 300 serves also to support at least those retention units 200 under which arm portion 324 passes against vertical drooping or deflection. To ensure sufficient strength and rigidity, brace unit 300 is also preferably formed of a metallic or other material having comparable properties, galvanized or otherwise condition/treated to withstand extended periods of exposure to wet, extreme environmental conditions.

Figure 9:
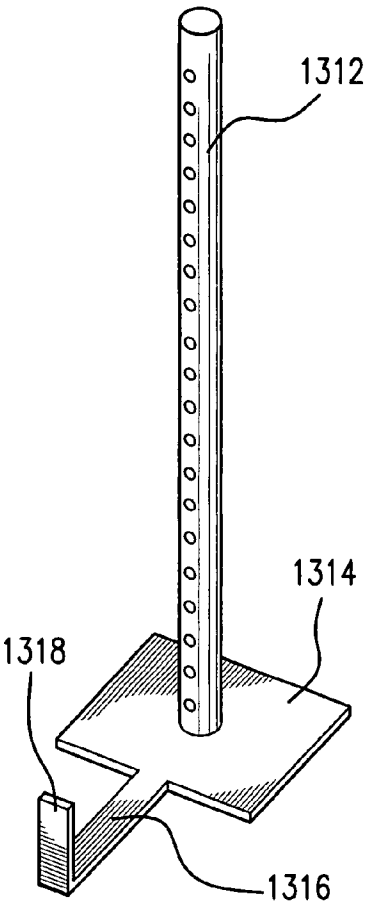
FIG. 9 is an alternate embodiment of still another portion of the present invention shown in FIG. 2.

Pole portion 312 is preferably formed with a sharply pointed bottom end, much like a stake, such that it may be readily driven into the ground or other underlying support surface. Where the underlying support surface is overly hard, or is one which cannot be disturbed (paved surfaces, for example), alternate embodiments of pole portion 312 such as shown in FIG. 9 may be employed. In that alternate embodiment, pole portion 1312 is mounted at its bottom to a base structure 1314 which permits pole portion 1312 to remain freestanding. This base structure 1314 may include an extension 1316 configured to extend to—and pass beneath, if necessary—the bottom-most retention unit 200 of the given barrier section. A bent termination 1318 extends upward from extension 1316 to bear against a side of that retention unit 200. Bent termination 1318 may be fastened, if necessary, to the retention unit surface for greater security of coupling. Pole portion 1312 is thereby maintained at a fixed distance from the given retention unit 200.

Where appropriate, a rib or some other vertically protruding formation may be included intermediately on extension 1316 spaced from bent termination 1318. This formation and bent termination 1318 would be spaced by the retention unit's thickness, so as to snugly and securely receive an edge portion of that retention unit.

Turning now to FIGS. 5-6, there is shown in greater detail the exemplary embodiment of retention unit 200 illustrated in FIGS. 1-2. Retention unit 200 includes a plank member 210 preferably formed with a longitudinally extended board-like contour defining a pair of opposed engagement portions 212 and an intermediate portion 214 extending longitudinally therebetween. Plank member 210 may be formed with any suitable dimensional configuration, so long as the engagement portions 212, at least, are dimensioned in thickness to engage the elongate channels of the support unit engagement sections in smoothly slidable manner.

In the embodiment shown, each plank member 210 is formed of a wooden material, but it may be formed of any other suitable material known in the art. Preferably, plank members 210, as well as other parts of retention unit 200, are formed of a liquid-impervious material that is of sufficient strength, rigidity, and durability to withstand repeated and extended periods of contact with risen waters and water-borne debris, without excessive deflection, deformation, or compositional degradation. Preferably, the material used is also of sufficient density such that it is not overly buoyant yet not so heavy to hinder convenient handling. It is important in various implementations of the present invention that the components of the subject reconfigurable barrier system 10 be sufficiently portable and readily manipulable for quick and convenient assembly/disassembly. While various materials other than that shown, such as plastic, metal, composite, and other materials of suitable properties may be employed for plank member 210, the actual choice of material is to be made in light of the dimensional and other configurational constraints bearing on the intended application.

Each retention unit 200 includes in addition to a plank member 210 a seal portion 220 extending along at least the longitudinal edge of that plank member 210. In the embodiment shown, seal portion 220 is realized in the form of a rubber or other liquid impervious and resilient strip which engages an abutting surface—either a longitudinal edge of another plank member 210 or the supporting surface itself. This minimizes the seepage of water or other liquid between or beneath a barrier section's retention units 200.

The resilient strip embodiment of seal portion 220 may be realized with any other suitable configuration known in the art. In certain applications, a plurality of retention units 200 may be employed in edge-to-edge stacked manner, with the bottom-most retention unit 200 extending along an uneven ground surface. It may be suitable in such cases to employ in the bottom-most retention unit 200B a plank member 210B having a more substantial seal portion 220B specifically configured to ensure adequate conformity with the uneven ground surface beneath it while maintaining a proper sealing effect, such as illustrated in FIG. 6B. As they would engage a relatively uniform upper edge of another retention unit 200, it may be sufficient to equip the other retention units 200 with simply a weather-strip like resilient member to provide an adequately conformed seal against the upper longitudinal edge of the plank member 210 below. Alternatively, some or all of the other retention units 200A may be formed as shown in FIG. 6A with a seal portion 220A having a side-offset flap configuration which provides an overlapping flap cover over the direct edge-to-edge junction of the stacked plank members 210A of retention units 200A. The flap in this embodiment—like the various seal portion components in other embodiments—may be coupled to their plank members by any suitably secure means known in the art.

In alternate embodiments such as illustrated in FIGS. 7-8, each retention unit 1200 may include a seal portion integrally formed with plank member 1210. As shown, one lateral edge of plank member 1210 may be formed with a longitudinally-extended protruding tongue 1222, and the other lateral edge of that plank member 1210 may be formed with a corresponding longitudinally-extended groove 1224. When edgewise stacked one over the other, an intimate tongue and groove engagement is realized between the stacked retention units 1200. The bottom-most retention unit 1200 may still be provided in such embodiments with an extraneous resilient seal portion much like the seal portion 220 shown in FIGS. 5-6, so as to ensure adequately conformed engagement of the underlaying support surface.

In the alternate embodiment of FIGS. 7-8, appropriately-shaped notches may be formed in the respectively joined lateral edges of stacked retention units 1200 to cooperatively form an access opening 1230 to accommodate the passage of a brace unit tie member's arm portion 324 therethrough. Access opening 1230 may be formed with any configuration suited to the size and contour of tie member arm portion 324; and, supplemental seal measures (such as O-rings, resilient flaps, and the like) may be suitably employed as necessary to minimize the seepage of water or liquids through access opening 1230.

Referring back to FIGS. 1-2, the intercoupling of components in system 10 may be further secured by fixing one or more retention units 200 to their support units 100. This may be accomplished by simply applying a screw or other type of extraneous fastening measure (not shown) to corresponding portions of the support unit engagement sections 110 and the retention unit engagement portions held therein.

Figure 10B:
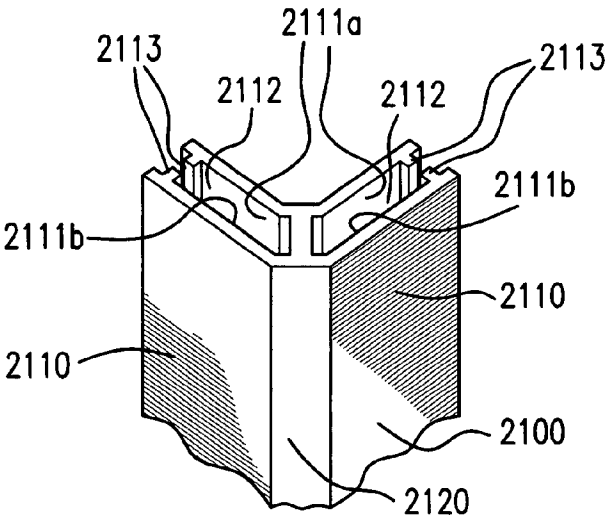
FIG. 10B is an outer perspective view, partially cutaway, of an alternate embodiment of the portion of the present invention shown in FIGS. 3A and 3B.
Figure 10A:
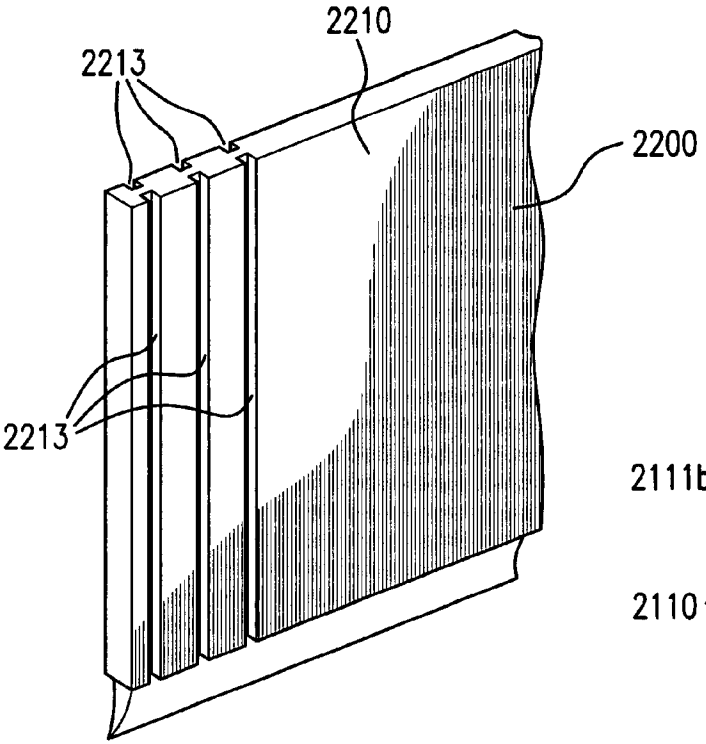
FIG. 10A is a perspective view, partially cutaway, of a second alternate embodiment of the portion of the present invention shown in FIGS. 5 and 6.

Such extraneous fastening measures are obviated by the alternate embodiment shown, for example, in FIGS. 10A-10B. In the embodiment there shown, each retention unit 2200 includes a plank member 2210 formed at its engagement portions with one or more retention slots 2213, disposed preferably at both the inner and outer sides thereof. Each support unit 2100 is then formed with engagement sections 2110 defining elongate channels 2112. An elongate pair of opposed retention ribs 2113 are formed respectively on each engagement section's inner and outer faces 2111*a*, 2111*b* to protrude therefrom into elongate channel 2112. Retention ribs 2113 extend lengthwise along the inner and outer faces 2111*a*, 2111*b*, to serve effectively as tracks which the corresponding retention slots 2213 of retention unit 2200 slidably engage upon insertion of a retention unit's engagement portion into the given channel 2112 of support unit 2100.

The exemplary retention unit 2200 is shown in FIG. 10A with multiple sets of retention slots 2213 spaced respectively at different distances from the terminal side edge of its plank member 2210 as shown. This enables the retention unit's use with any one of several differently sized support units 2100.

As mentioned in preceding paragraphs, the depth of each elongate channel defined by a support unit's engagement section may be varied depending on such factors as the given barrier section's retention unit span length. Longer span lengths, for instance, may necessitate deeper channels 2112, hence wider inner and outer faces 2111*a*, 2111*b*, to ensure sufficiently secure intercoupling of a retention unit 2200 to support unit engagement section 2110. The same retention unit 2200 may then be used with any one of several support units 2100 having different-sized engagement portions 2110—whose retention ribs 2113 are displaced from intermediate section 2120 by different extents.

Figure 11:
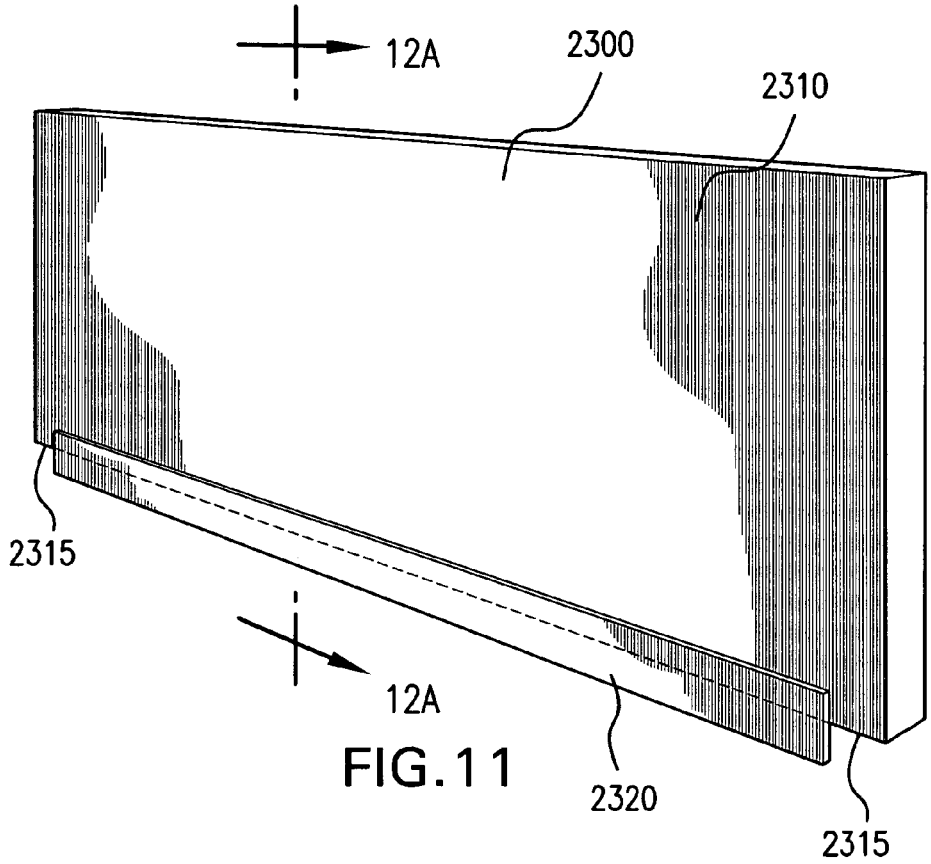
FIG. 11 is a perspective view of a third alternate embodiment of the portion of the present invention shown in FIGS. 5 and 6.

Referring to FIG. 11, there is shown a retention unit 2300 formed in accordance with another exemplary embodiment of the present invention. In this embodiment, retention unit 2300 includes a plank member 2310 along the bottom longitudinal edge of whose intermediate portion spans a seal portion 2320 having preferably a blade-like configuration. This seal portion 2320 defines an elongate sheet member securely attached by any suitable means to plank member 2310 such that it projects transversely beyond the plank member's longitudinal edge for penetrating engagement with the ground or other supporting surface beneath.

Preferably, this sheet member 2320 is formed of a metallic or any other suitable material known in the art having sufficient strength and rigidity to serve, if necessary, as a driving edge as well as a sealing and retaining panel once it is fully positioned in engagement with the supporting surface. In its simplest form, sheet member 2320 is preferably formed with a suitable flatness to effectively serve such blade-like driving function.

The resulting retention unit 2300 is thus suited for use as the bottom-most retention unit in each barrier section 15 that is erected on terraneous dirt, grass, or other unpaved/uncovered surfaces. The structure is particularly advantageous with terraneous surfaces which tend to be uneven to the point that open gaps would otherwise result underneath sealing members placed to rest thereon. The continuous subterraneous engagement provided by the bottom-projecting sheet member 2320 along its entire longitudinal length, when properly positioned, ensures a continuous seal beneath the given plank member's intermediate portion. Sheet member 2320 is dimensioned accordingly to block these would-be gaps underneath.

As shown, sheet member 2320 is preferably dimensioned in its longitudinal length to remain sufficiently clear of the plank member's laterally-opposed engagement portions 2315. This keeps sheet member 2320 from interfering with proper sliding engagement of engagement portions 2315 with their respective receiving channels 112 (of the given support units 100).

Figure 12A:
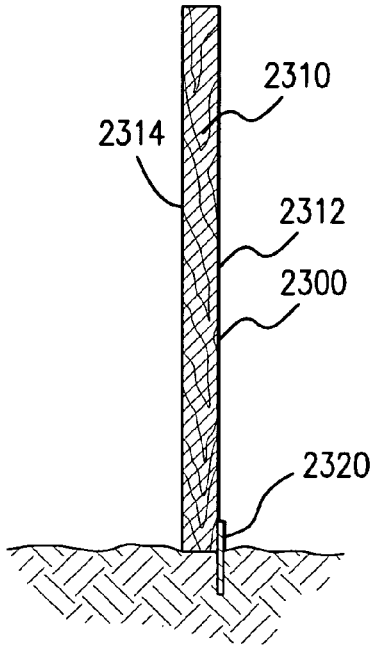
FIG. 12A is a sectional view of the portion of the present embodiment shown in FIG. 11.
Figure 12B:
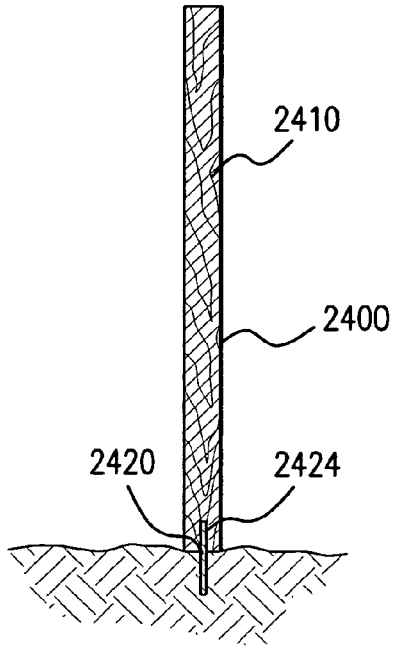
FIG. 12B is a sectional view of yet another alternate embodiment of the portion of the present invention shown in FIG. 11.

Turning to the sectional views shown in FIGS. 12A-12B, sheet member 2320 may be variously disposed on plank member 2310 in accordance with various alternate embodiments of the present invention. In the embodiment illustrated in FIG. 12A, sheet member 2320 is attached in partially overlapped manner to a front vertical face 2312 of plank member 2310. Alternatively, sheet member 2320 may be similarly attached to a rear vertical face 2314 of plank member 2310 either in place of, or in addition to, the sheet member 2320 being attached to the front vertical face 2312, for example. In the embodiment of FIG. 12B, one or more sheet members 2420 may be partially imbedded within plank member 2410 (of retention unit 2400) to protrude outward from a receiving recess 2424 formed along the plank member's bottom longitudinal edge. Note that while sheet member 2320, 2420 is shown in each illustrated embodiment to be a separate and distinct member suitably affixed to the given plank member 2310, 2410, it may, in certain other embodiments, be integrally formed with such plank member 2310, 2410.

Figure 13:
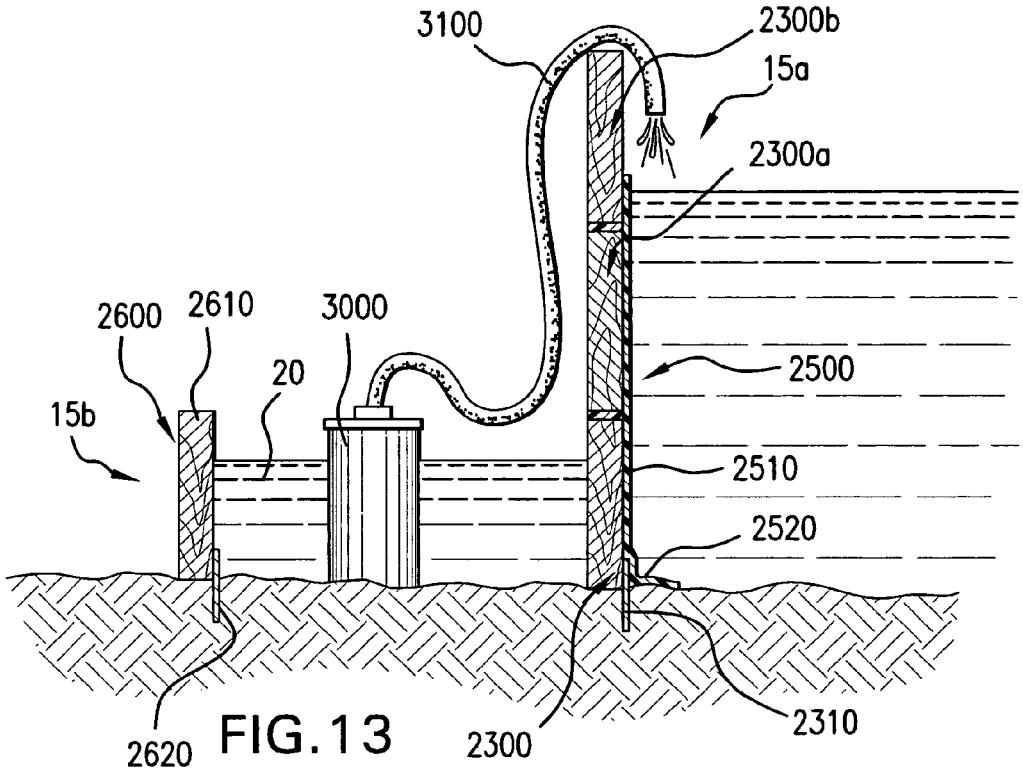
FIG. 13 is a partial sectional view of an alternate embodiment of the present invention schematically illustrating an exemplary application.

Referring now to FIG. 13, there is shown a partial cross sectional view illustrating certain aspects of a system erected in accordance with another alternate embodiment of the present invention. In this embodiment, the system includes a reconfigurable primary, or outer, barrier formed by a plurality of primary barrier sections 15*a* joined one to the other to extend about an area to be protected, and a reconfigurable secondary, or inner, barrier formed by a plurality of secondary barrier sections 15*b* joined one to the other to extend within the primary barrier spaced therefrom, as schematically illustrated in FIG. 1. A secondary level of protection is thus provided by this multi-barrier embodiment, with the secondary barrier internally bounding a moat-like structure 20 behind the primary barrier for the safe residual collection of any liquid which happens to seep through or otherwise bypass the primary barrier. One or more pump units 3000 and conduits 3100 may be disposed as shown to expel the residually collected liquid from this moat-structure 20. Pump unit 3000 may be of any suitable type known in the art, such as a sump pump and the like.

Each primary barrier section 15*a* shown in this embodiment includes at least a bottom-most retention unit 2300 supported to extend between a pair of support units 100 (which are not shown in this view to preserve brevity and clarity) as described in preceding paragraphs. Each primary barrier section 15*a* may include (as illustrated) one or more additional retention units 2300*a*, 2300*b* stacked thereover as needed. Preferably, the bottom-most retention unit 2300 is configured as shown in FIG. 12A, with a blade-like sheet member 2310 subterraneously engaging the uneven and inconsistent surface underneath. The upper stacked retention units 2300*a*, 2300*b* may be of any other suitable configuration disclosed herein, such as those disclosed with reference to FIGS. 5-8, for example.

As an added measure of protection, the primary barrier formed in accordance with this embodiment further includes a continuous outer wrap layer 2500 overlaying at least a portion of each primary barrier section 15*a*. This outer wrap layer 2500 is preferably positioned such that its upper portion 2510 extends fully over each joint between stacked retention units 2300, 2300*a*, 2300*b* to further guard against the seepage of liquid therethrough. Preferably, a lower portion 2520 provides ample surplus wrap material to form a skirt-like extension which fully enshrouds the terrestrial seam beneath the bottom-most retention unit 2300.

The secondary barrier may be even more simply erected than the primary barrier, given its back-up, seal-reinforcing function. As such, each secondary barrier section 15*b* may be formed simply by a secondary retention unit having a structure much like that of the bottom-most retention unit 2300 of a primary barrier section. Each secondary retention unit 2600 is preferably formed with a plank member 2610 provided with a blade-like sheet member 2620 largely corresponding in structure and function to sheet member 2320 of a primary barrier section's bottom-most retention unit 2300. Though the primary barrier's structure may be substantially duplicated in the secondary barrier where necessary, and where afforded by the available resources, secondary barrier sections 15*b* are preferably joined in the embodiment shown without any intervening support unit 100. Sheet member 2620 of each secondary barrier section 15*b* may accordingly span and even exceed the entire length of its plank member 2610, as no clearance need be maintained for any slotted engagement with a support unit 100 channel.

Figure 14:
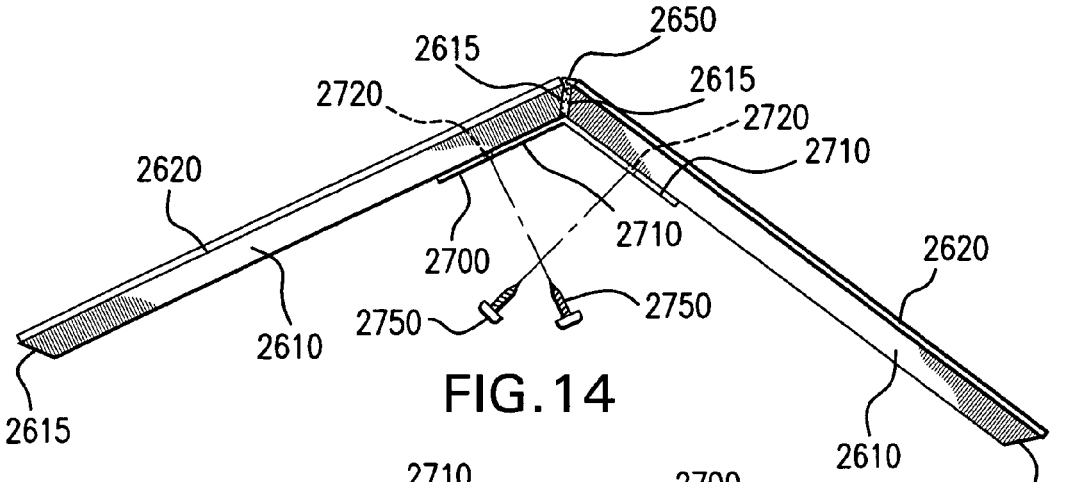
FIG. 14 is a plan view of a portion of the alternate embodiment illustrated in FIG. 13.

Adjacent ones of secondary retention units 2600 are joined end to end to follow the primary barrier's profile about the area to be protected. Preferably, the lateral edge surfaces 2615 of each secondary retention unit plank member 2610 is formed with an angled face, much as if it were mitre-cut for example, as shown in FIG. 14. Opposing angled faces 2615 of adjacent plank members 2610 maximize the evenness of fit at their interface, so as to minimize the potential for leakage therethrough. Preferably, a seal strip 2650 formed of a liquid-impervious resilient material is captured to extend in conformed manner between opposing lateral angled faces 2615.

Figure 15A:
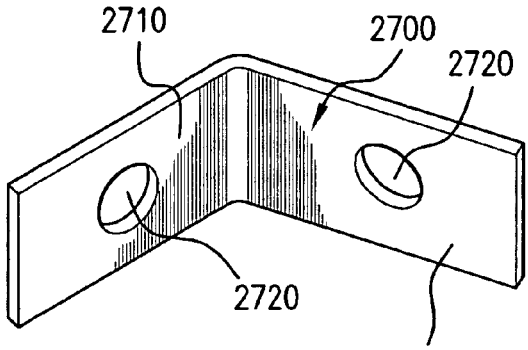
FIG. 15A is a perspective view of an exemplary embodiment of a fixture reinforcing member which may be employed in the system embodiment illustrated in FIGS. 13 and 14.

The resulting joint between adjacent secondary retention units 2600 is preferably both secured and reinforced by one or more angled face brackets 2700 suitably configured as shown in FIG. 15A, for example. Preferably, each face bracket 2700 is formed of metallic, plastic, or other such suitable material known in the art having the strength, rigidity, and durability required for the intended application. Each face bracket 2700 is fastened to the adjoined plank members 2610 by any suitable means known in the art.

In the embodiment shown, each face bracket 2700 includes angularly offset face plate portions 2710 in which one or more through holes 2720 are respectively formed. Face bracket 2700 may then be positioned at the given joint with its face plate portions 2710 bearing against respective faces of the plank members 2610. Screw or other suitable fasteners 2750 may then be passed into the through holes 2720 to mount the face place portions 2710 against the plank member faces.

In other embodiments, face bracket 2700 may be disposed in accordance with various configurations other than that shown in this illustrative embodiment. For example, face bracket 2700 may be disposed outside, rather than inside, the angled joint of adjacent secondary retention units 2600 shown in FIG. 14. Moreover, each face bracket 2700 itself may be formed with any other structural configuration suitable for the intended application.

Figure 15B:
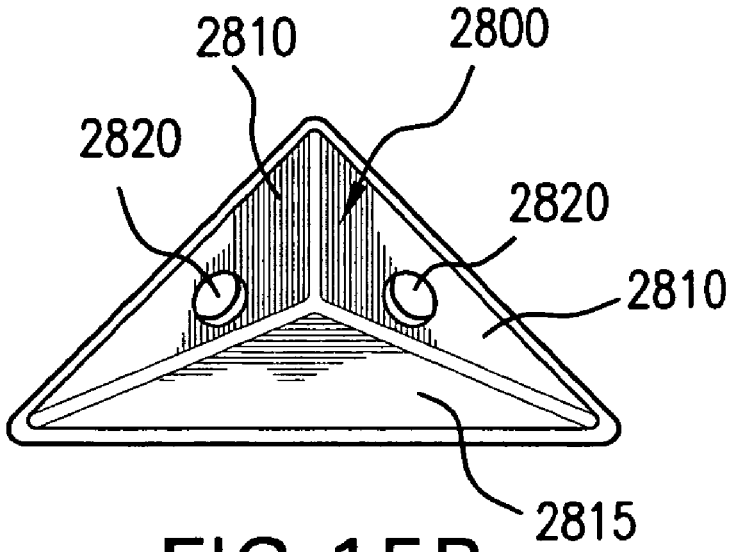
FIG. 15B is a perspective view of another exemplary embodiment of a fixture reinforcing member which may be employed in the system embodiment illustrated in FIGS. 13 and 14.

In the exemplary embodiment of FIG. 15B, for instance, face bracket 2800 is formed with a corner reinforcement structure which includes a pair of angularly offset face place portions 2810 which are reinforced against relative angular movement by a floor portion 2815 extending transversely therebetween. Through holes 2820 are preferably formed in respective face plate portions 2810 to facilitate the bracket's mounting by appropriate fasteners against adjoined plank members 2610, much as illustrated in the embodiment of FIG. 14. Floor portion 2815 reinforces even more the strength and rigidity of the resulting face bracket.

Figure 15C:
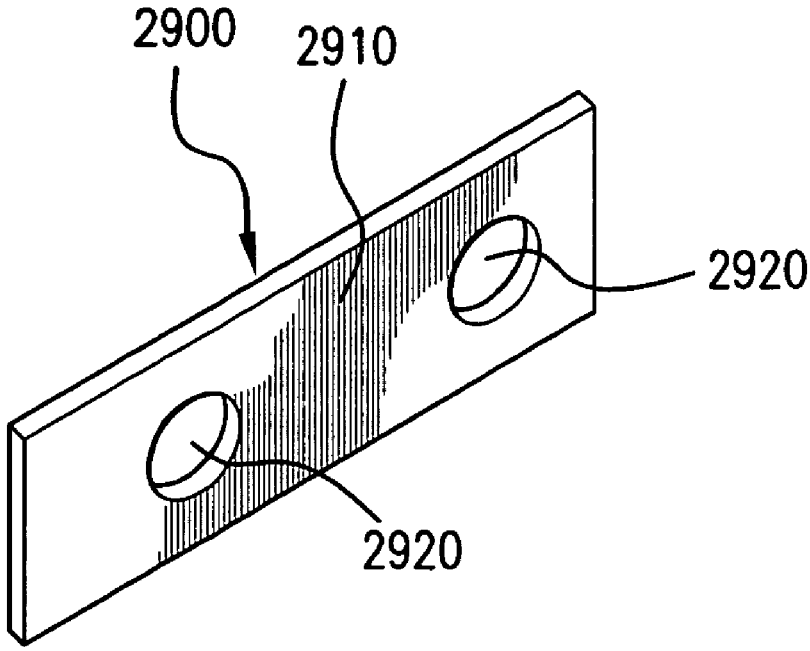
FIG. 15C is a perspective view of yet another exemplary embodiment of a reinforcing member which may be employed in the system embodiment illustrated in FIG. 13.

The straight band structure shown for face plate 2900 in the alternate exemplary embodiment of FIG. 15C may be employed where the application necessitates a more in-line mutual orientation of certain adjoined secondary retention units 2600. In this embodiment, a planar face plate portion 2910 extends across the joint of adjacent secondary retention units 2600; and, plurality of accommodating through holes 2920 are formed offset one from the other in that face plate portion 2910.

In practice, the peripheral contour of the area to be protected may vary sufficiently from application to application. Consequently, it may be necessary in actual practice to employ a combination of variously configured face bracket components in much the same manner that a combination of variously configured retention units 2600 may be employed. Though not shown, such variously configured retention units 2600 may include plank members 2610 having various height, thickness, and length dimensions. They may also include squared or other faces variously angled at one or more lateral edge 2615.

Figure 16A:
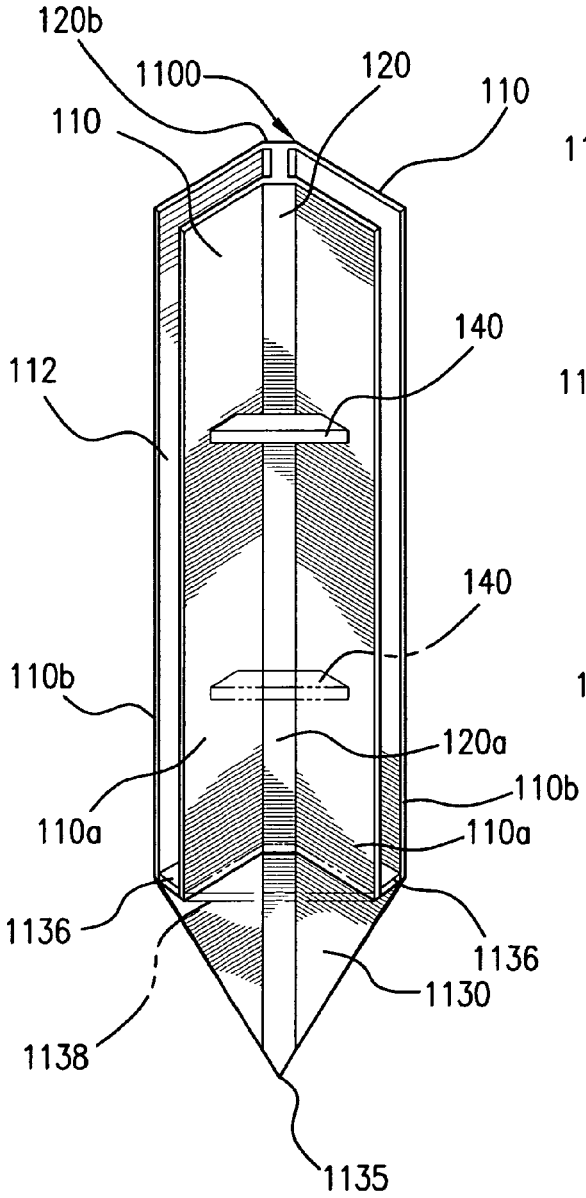
FIG. 16A is an inner perspective view of an alternate embodiment of the portion of the present invention shown in FIGS. 3A and 3B; and, FIG. 16B is an outer perspective view of the portion shown in alternate embodiment in FIG. 16A.
Figure 16B:
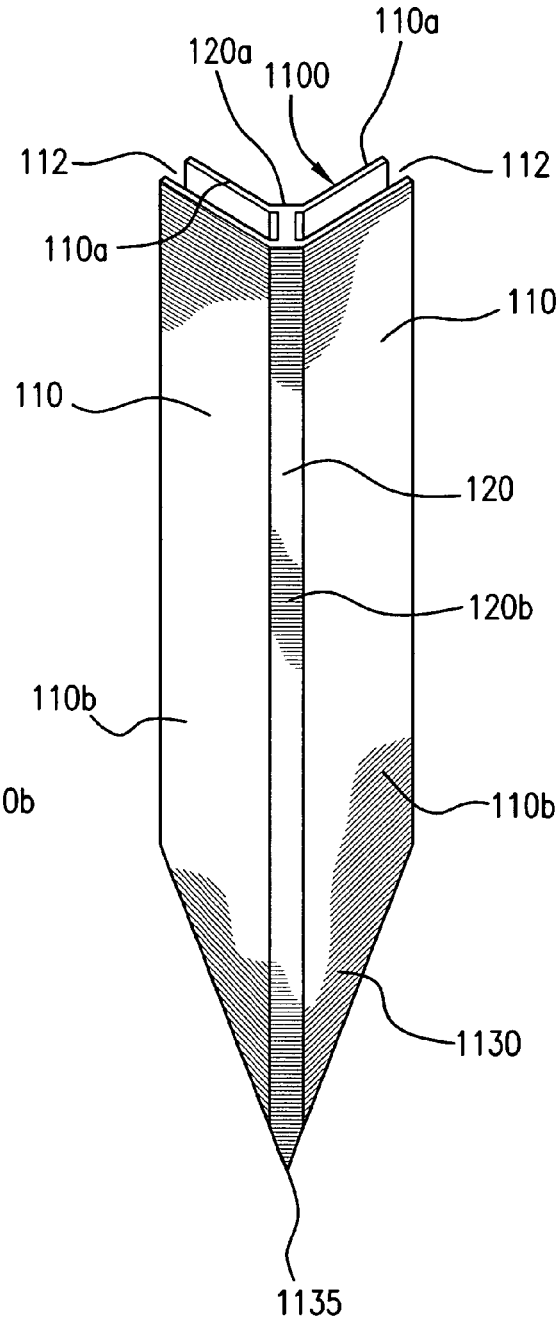

Turning next to FIGS. 16A-16B, there is shown a support unit 1100 formed in accordance with yet another alternate embodiment of the present invention. This embodiment, also suited preferably for unpaved/unimproved terrestrial applications, includes engagement and intermediate sections 110, 120 like those of the embodiment shown in FIGS. 3A-3B, with like reference characters corresponding to like features thereof. Support unit 1100 in this embodiment, however, is formed with a base section 1130 which extends longitudinally downward from the intermediate and engagement sections 120, 110 to converge at a pointed tip 1135. The pointed, shovel-like configuration which results aids in subterraneously penetrating the given surface, as well as in retentively anchor unit 1100, once it is driven into position.

While it is shown to extend from each of the outer engagement and intermediate section panels 110*b*, 120*b*, base section 1130 may in other embodiments be formed to extend either alternatively or supplementally from the inner engagement and intermediate section panels 110*a*, 120*a*. Stable support for retention units slidably held within each channel 112 is maintained in this embodiment by a channel base 1136, which serves as a supporting floor extending across the bottom of each channel 112.

Although not fully shown, handles or other such additional features may be provided in accordance with certain other aspects of this embodiment to aid a user in the installation and removal of support unit 1100, where the intended application would make necessary. One of numerous examples of such features is illustrated in the form of a base panel member 1138 transversely spanning the space defined by the inner engagement and intermediate section panels 110*a*, 120*a* at or near base section 1130. A user may conveniently employ such base panel member 1138 as a stepping, or pounding, surface to safely and effectively apply the force necessary to sufficiently drive the base section 1130 into the supporting surface underneath.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, the numbers and arrangement of certain features may be varied from that shown and described, and in certain cases, various features may be reversed or interposed, all without departing from the spirit or scope of the invention as defined in the appended claims.

What is claimed is:

1. A reconfigurable barrier system comprising:

(a) a plurality of support units spaced one from the other, each said support unit having at least one engagement section defining an elongate channel;

(b) a plurality of retention units each supported to extend between a pair of said support units, each said retention unit being substantially impervious to liquid and including:

i. a pair of opposed engagement portions and an intermediate portion extending therebetween, each said engagement portion slidably engaging one said channel of one said support unit; and, ii. a seal portion extending along a longitudinal edge of said intermediate portion;

said seal portion of at least one said retention unit including a planar elongate sheet member disposed on said intermediate portion to project transversely beyond said longitudinal edge for penetration into a supporting surface; and, (c) at least one brace unit engaging at least one said retention unit for reinforcing the support thereof, said brace unit including a stabilizing member and a tie member extending therefrom to supportingly engage said retention unit;

a barrier section being defined by a pair of said support units supporting at least one said retention unit supported thereby;

wherein said tie member of said brace unit is adjustably coupled to said stabilizing member thereof;

said stabilizing member including a pole portion having a plurality of through holes formed therein; and, said tie member including:

(1) a collar portion coaxially engaging said pole;

(2) an arm portion extending radially from said collar portion; and, (3) a hook portion terminating said arm portion for engaging at least one said retention unit.

2. The reconfigurable barrier system as recited in claim 1 wherein at least one barrier section includes a plurality of said retention units extending between said support units thereof in stacked manner one over the other; said system further comprising a liquid impervious outer wrap overlaying at least a portion of said barrier section to extend over each joint between stacked ones of said retention units.

3. The reconfigurable barrier system as recited in claim 2 wherein each said support unit includes:

at least a pair of said engagement sections offset in angular orientation one from the other;

an intermediate section disposed between said engagement sections, said intermediate section having a substantially I-shaped sectional contour; and, a base section coupled to said intermediate and engagement sections to extend longitudinally downward therefrom, said base section converging to a pointed tip for penetration into a supporting surface.

4. The reconfigurable barrier system as recited in claim 2 comprising a plurality of said barrier sections joined one to the other to form a first endlessly looped barrier configuration about an area to be protected; a plurality of secondary barrier sections joined one to the other to form a second endlessly looped barrier configuration disposed within said first endlessly looped barrier configuration in spaced manner therefrom; and, a pump unit disposed between said first and second endlessly looped barrier configurations for expelling liquid residually collected thereat.

* * * * *